US011046538B2

(12) United States Patent
Kitayama

(10) Patent No.: US 11,046,538 B2
(45) Date of Patent: Jun. 29, 2021

(54) IMAGE FORMING APPARATUS

(71) Applicant: KYOCERA Document Solutions Inc., Osaka (JP)

(72) Inventor: Kaori Kitayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 244 days.

(21) Appl. No.: 16/513,069

(22) Filed: Jul. 16, 2019

(65) Prior Publication Data

US 2020/0026232 A1 Jan. 23, 2020

(30) Foreign Application Priority Data

Jul. 23, 2018 (JP) ..... JP2018-137360

(51) Int. Cl.

*B65H 7/06* (2006.01)
*B65H 7/02* (2006.01)
*B65H 5/06* (2006.01)

(52) U.S. Cl.

CPC ..... *B65H 7/06* (2013.01); *B65H 5/062* (2013.01); *B65H 7/02* (2013.01); *B65H 2511/514* (2013.01); *B65H 2511/518* (2013.01); *B65H 2511/528* (2013.01); *B65H 2513/50* (2013.01); *B65H 2513/512* (2013.01); *B65H 2513/514* (2013.01); *B65H 2601/11* (2013.01); *B65H 2601/255* (2013.01); *B65H 2701/1311* (2013.01); *B65H 2701/1313* (2013.01); *B65H 2801/06* (2013.01)

(58) Field of Classification Search

CPC ..... B65H 7/06; B65H 2601/11; B65H 2511/528; B65H 2601/255; B65H 2701/1311; B65H 2701/1313; B65H 2513/50

See application file for complete search history.

(56) References Cited

U.S. PATENT DOCUMENTS 7,611,143 B2 * 11/2009 Walsh ..... B65H 5/062 271/265.02
7,628,393 B2 * 12/2009 Mitsuya ..... B65H 3/0653 271/10.01
8,585,052 B2 * 11/2013 Hirata ..... B65H 29/62 271/259

(Continued)

FOREIGN PATENT DOCUMENTS

JP 2002-205838 A 7/2002

*Primary Examiner* — Jeremy R Severson
(74) *Attorney, Agent, or Firm* — Stein IP, LLC

(57) ABSTRACT

An image forming apparatus has a sheet feed portion, a conveying portion, a control portion, a first sensor having the detection position at a first position in the sheet conveying passage, and a second sensor having the detection position at a second position downstream of the first position in the sheet conveying direction. The control portion performs first sensing to sense whether the sheet's rear end has passed the first position within a first time of the start of the feeding and second sensing to sense whether the sheet's rear end has passed the second position within a second time of the start of the feeding. Even if the control portion is unable to sense passage of the sheet's rear end in the first sensing, when it senses passage of the sheet's rear end in the second sensing, it makes the conveying portion continue feeding the sheet.

5 Claims, 6 Drawing Sheets

(56) References Cited

U.S. PATENT DOCUMENTS

| | | | | |
|---|---|---|---|---|
| 8,960,672 | B2 * | 2/2015 | Takenaka | B65H 15/00 271/259 |
| 9,027,925 | B2 * | 5/2015 | Alaas | G03G 15/6511 271/259 |
| 10,450,156 | B2 * | 10/2019 | Mizuno | B65H 7/14 |
| 2002/0066994 | A1 | 6/2002 | Nakano et al. | 271/121 |
| 2018/0267451 | A1 * | 9/2018 | Hirano | B65H 7/14 |

* cited by examiner

IMAGE FORMING APPARATUS

INCORPORATION BY REFERENCE

This application is based upon and claims the benefit of priority from the corresponding Japanese Patent Application No. 2018-137360 filed on Jul. 23, 2018, the entire contents of which are incorporated herein by reference.

BACKGROUND

The present disclosure relates to an image forming apparatus that conveys a sheet used in a print job.

When executing the print job, a conventional image forming apparatus conveys a sheet along a sheet conveying passage, and while conveying it, prints an image on the sheet.

For example, the conventional image forming apparatus includes a sheet feed portion and a separating portion. The sheet feed portion feeds a sheet into a sheet conveying passage. The separating portion separates one from another the sheets to be fed into the sheet conveying passage. By providing the separating portion in the image forming apparatus, it is possible to prevent a sheet fed earlier (precedent sheet) moving together with the sheet to be fed next (next sheet).

SUMMARY

According to one aspect of the present disclosure, an image forming apparatus includes a sheet feed portion, a conveying portion, a sheet feed sensor, and a control portion. The sheet feed portion feeds a sheet used in a print job into a sheet conveying passage. The conveying portion conveys the sheet fed into the sheet conveying passage. The sheet feed sensor has the detection position at a position previously determined in the sheet conveying passage and changes its output according to whether or not a sheet is present at the detection position. The control portion controls the sheet feed portion and the conveying portion, and senses the arrival of the tip end of and the passage of the rear end of a sheet at the detection position based on the output of the sheet feed sensor. The sheet feed sensor is provided with a first sensor having the detection position at a first position in the sheet conveying passage and a second sensor having the detection position at a second position on the downstream side, in the sheet conveying direction, of the first position in the sheet conveying passage. The control portion sets a first time equal to the time obtained by adding a first margin time to a first theoretical time required from the start of the feeding of a sheet by the sheet feed portion to the passage of the rear end of the sheet at the first position, and sets a second time equal to the time obtained by adding a second margin time to a second theoretical time required from the start of the feeding of a sheet by the sheet feed portion to the passage of the rear end of the sheet at the second position. Based on the output of the first sensor, the control portion performs first sensing in which it senses whether or not the rear end of the sheet has passed the first position within the first time of the start of the feeding of the sheet by the sheet feed portion, and based on the output of the second sensor, the control portion performs second sensing in which it senses whether or not the rear end of the sheet has passed the second position within the second time of the start of the feeding of the sheet by the sheet feed portion. Even if unable to sense the passage of the rear end of the sheet at the first position, when the passage of the rear end of the sheet is sensed in the second sensing, the control portion makes the conveying portion continue feeding the sheet.

DETAILED DESCRIPTION

Structure of an Image Forming Apparatus

Figure 1:
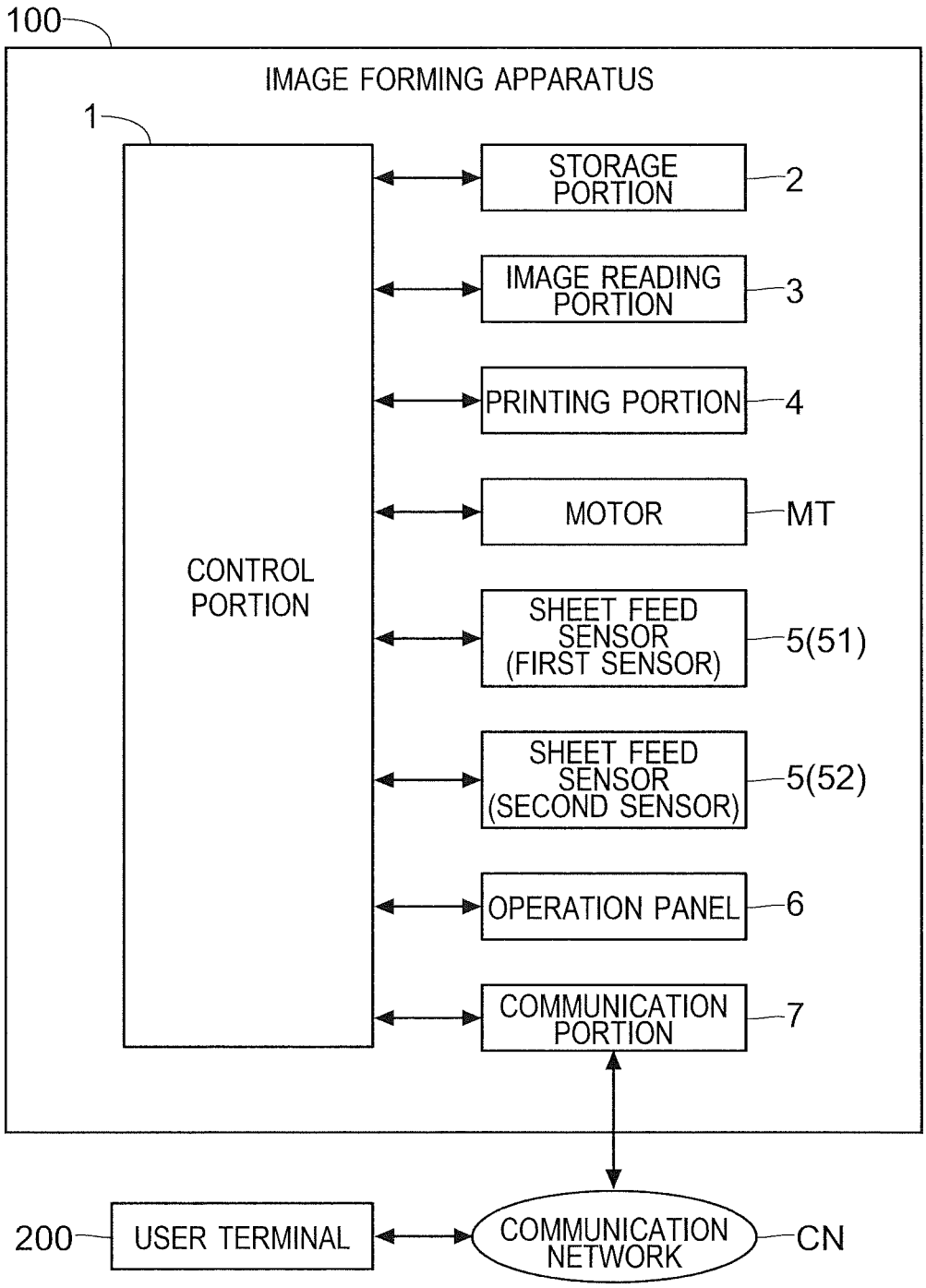
FIG. 1 is a block diagram showing a configuration of an image forming apparatus according to one embodiment of the present disclosure.

As shown in FIG. 1, an image forming apparatus 100 according to an embodiment includes a control portion 1 and a storage portion 2. The control portion 1 includes a CPU. Based on programs and data for control, the control portion 1 executes processes for controlling different blocks in the image forming apparatus 100. The storage portion 2 includes a ROM and a RAM. The storage portion 2 stores programs and data for control. The storage portion 2 is connected to the control portion 1. The control portion 1 reads information from the storage portion 2 and writes information to the storage portion 2.

The image forming apparatus 100 includes an image reading portion 3 and a printing portion 4. The image reading portion 3 and the printing portion 4 are connected to the control portion 1. The control portion 1 controls reading operation by the image reading portion 3 and printing operation by the printing portion 4.

The image reading portion 3 includes optical members (unillustrated) that optically read a document. The optical members include a light source and an image sensor. The light source irradiates a document with light. The image sensor receives light reflected from the document and performs photoelectric conversion.

When a printing job is executed, the printing portion 4 conveys a sheet P (see FIG. 2) and forms an image to be printed, and then while conveying it, prints the image on the sheet P. For example, the printing portion 4 prints based on image data acquired by the image reading portion 3 reading a document.

Figure 2:
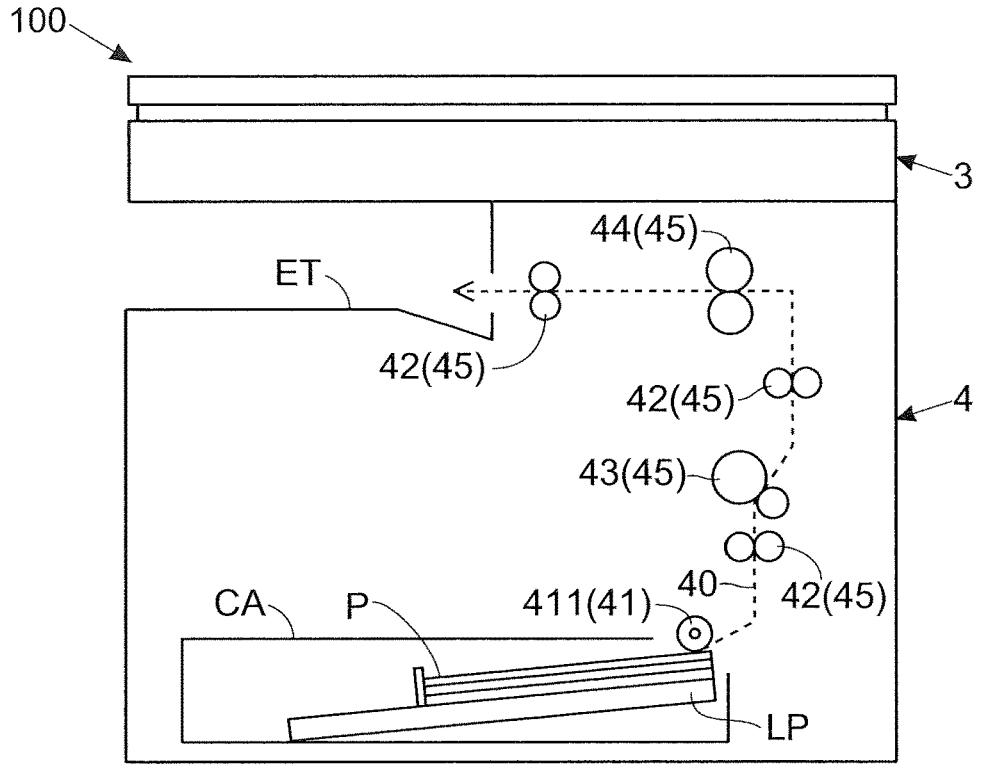
FIG. 2 is a schematic diagram showing a structure of the image forming apparatus according to the one embodiment of the present disclosure.

As shown in FIG. 2, the printing portion 4 includes a sheet conveying passage 40 (in FIG. 2, indicated by a broken-line allow). The printing portion 4 also includes a sheet feed portion 41. The sheet feed portion 41 includes a pickup roller 411. The sheet feed portion 41 feeds a sheet P into the sheet conveying passage 40.

A sheet P to be fed into the sheet conveying passage 40 by the sheet feed portion 41 is stored in a sheet feed cassette CA. The sheet feed cassette CA is removable from the image forming apparatus 100. The sheet P stored in the sheet feed cassette CA is placed on a lift plate LP. The pickup roller 411 is arranged over the sheet P stored in the sheet feed cassette CA.

When a sheet P is fed into the sheet conveying passage 40, the pickup roller 411 makes contact with the sheet P in the sheet feed cassette CA, and while in contact with it, the pickup roller 411 rotates. Thus, the sheet P is extracted from the sheet feed cassette CA and is fed into the sheet conveying passage 40. As the sheets P in the sheet feed cassette CA decrease as a result of sheets P being fed into the sheet conveying passage 40, the lift plate LP rises. It is thereby possible to keep the pickup roller 411 in contact with the sheet P in the sheet feed cassette CA.

Although no illustration is given here, as a member constituting the sheet feed portion 41, a member may be included that separates from each other the sheets P extracted from the sheet feed cassette CA by the pickup roller 411, such as a separation roller or a friction pad.

A sheet P fed into the sheet conveying passage 40 is conveyed along the sheet conveying passage 40. The sheet conveying passage 40 is provided with a conveying roller pair 42 for conveying the sheet P along the sheet conveying passage 40. The conveying roller pair 42 corresponds to a conveying portion.

The conveying roller pair 42 has a conveying nip. One roller and the other roller of the conveying roller pair 42 are in pressed contact with each other, and thus the conveying nip is formed between one roller and the other roller. The conveying roller pair 42 rotates to convey the sheet P that has entered the conveying nip.

A plurality of conveying roller pairs 42 are provided in the sheet conveying passage 40. In FIG. 2, although three conveying roller pairs 42 are arranged along the sheet conveying passage 40, there is no restriction on the number of conveying roller pairs 42; it is possible to change it according to the length of the sheet P conveying passage. It is also possible to change the arrangement positions of the conveying roller pairs 42 according to the length of the sheet P conveying passage.

The printing portion 4 includes a transfer roller pair 43. The transfer roller pair 43 includes a photosensitive drum and a transfer roller. The photosensitive drum carries a toner image on its circumferential face. The transfer roller is in pressed contact with the photosensitive drum, and forms a transfer nip with the photosensitive drum.

A sheet P fed into the sheet conveying passage 40 is conveyed toward the transfer roller pair 43, and enters the transfer nip. The transfer roller pair 43 transfers a toner image to the sheet P while conveying the sheet P that has entered the transfer nip. The sheet P having the toner image transferred to it is conveyed toward a fixing roller pair 44.

Although no illustration is given here, the printing portion 4 includes a charging device, an exposure device, and a developing device. These devices and the transfer roller pair 43 constitute an image forming portion for forming a toner image to be transferred to a sheet P. The charging device electrostatically charges the circumferential face of the photosensitive drum. The exposure device forms an electrostatic latent image on the circumferential face of the photosensitive drum. The developing device develops the electrostatic latent image on the circumferential face of the photosensitive drum into a toner image.

The printing portion 4 includes a fixing roller pair 44. The fixing roller pair 44 includes a fixing roller and a pressing roller. The fixing roller incorporates a heater (unillustrated). The pressing roller is in pressed contact with a fixing roller, and forms a fixing nip with the fixing roller.

The sheet P having the toner image transferred to it is conveyed toward the fixing roller pair 44, and enters the fixing nip. The fixing roller pair 44 heats and presses the sheet P while conveying the sheet P that has entered the fixing nip. The toner image is thereby fixed to the sheet P. The sheet P having the toner image fixed to it is conveyed toward a discharge tray ET, and is eventually discharged onto the discharge tray ET.

In addition to the conveying roller pair 42, the transfer roller pair 43 and the fixing roller pair 44 serve to convey a sheet P. That is, the conveying roller pair 42, the transfer roller pair 43, and the fixing roller pair 44 all correspond to the conveying portion. In the following description, unless distinction is necessary, the conveying roller pair 42, the transfer roller pair 43, and the fixing roller pair 44 are collectively referred to as the conveying portion, and are identified by the reference sign 45.

Back in FIG. 1, the control portion 1 is connected to a motor MT for rotating various rotary members of the printing portion 4. The control portion 1 controls the motor MT to appropriately rotate the various rotary members of the printing portion 4. For example, a plurality of motors MT can be provided, and are allocated one to each of the pickup roller 411, the conveying roller pair 42, the transfer roller pair 43, and the fixing roller pair 44.

The image forming apparatus 100 includes a sheet feed sensor 5. The sheet feed sensor 5 is arranged in the sheet conveying passage 40. A plurality of sheet feed sensors 5 are arranged, and a plurality of positions along the sheet conveying passage 40 are previously determined as the detection positions of the sheet feed sensors 5. The plurality of sheet feed sensors 5 each change its output according to whether or not a sheet P is present at the corresponding detection position.

For example, the plurality of sheet feed sensors 5 are transmissive optical sensors each having a light emitting portion and a light receiving portion, and detect, as a target, actuators (unillustrated) which are swingably supported at the corresponding detection positions (inside the sheet conveying passage 40) so as to protrude. When the tip end of a sheet P reaches the corresponding detection positions, the plurality of actuators are pushed by the sheet P, and swing to one side, thereby to obstruct or open the optical path (detection region) between the light emitting portion and the light receiving portion. On the other hand, when the rear end of the sheet P has passed the corresponding detection positions, the plurality of actuators swing to the other side and return to their original position, thereby to open or obstruct the optical path (detection region) between the light emitting portion and the light receiving portion. Thus, the plurality of sheet feed sensors 5 change their output according to whether or not the sheet P is present at the corresponding detection positions.

The plurality of sheet feed sensors 5 are connected to the control portion 1. Based on the output of the plurality of sheet feed sensors 5, the control portion 1 senses the conveying state of a sheet P (the arrival of the tip end of a sheet P and the passage of the rear end of the sheet P at the detection positions) in the sheet conveying passages 40.

In this embodiment, two sheet feed sensors 5 are arranged. In the following description, one sheet feed sensor 5 is identified by the reference sign 51 and is referred to as a first sensor 51, and the other sheet feed sensor 5 is identified by the reference sign 52 and is referred to as a second sensor 52. The detection positions of the first and second sensors 51 and 52 are set at positions on the upstream side of the detection position of another, unillustrated, conveying sensor (a sensor for sensing the conveying state of the sheet P in the sheet conveying passage 40) in the sheet conveying direction.

Figure 3:
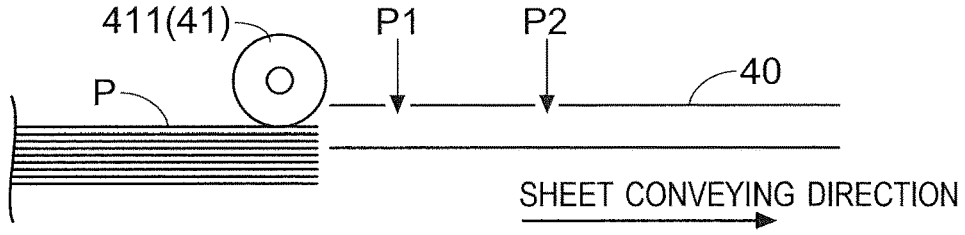
FIG. 3 is a diagram showing the detection positions of sheet feed sensors provided in the image forming apparatus according to the one embodiment of the present disclosure.

Here, with reference to FIG. 3, the detection positions of the first and second sensors 51 and 52 will be described. In FIG. 3, for the sake of convenience, the sheet conveying passage 40 is illustrated as extending in the left-right direction. The same applies to FIGS. 4 to 6, which will be referred to in the following description.

As shown in FIG. 3, of a plurality of detection positions including the detection position of the unillustrated conveying sensor, the detection position P1 that the tip end of the sheet P fed into the sheet conveying passage 40 reaches first is the detection position of the first sensor 51. The detection position P1 corresponds to a first position, and is referred to as the first position P1 in the following description.

Of the plurality of detection positions including the detection position of the unillustrated conveying sensor, the detection position P2 that the tip end of the sheet P fed into the sheet conveying passage 40 reaches second is the detection position of the second sensor 52. That is, the detection position P2 of the second sensor 52 is on the downstream side of the detection position P1 of the first sensor 51 in the sheet conveying direction. The detection position P2 corresponds to a second position, and is referred to as the second position P2 in the following direction.

Back in FIG. 1, the image forming apparatus 100 includes an operation panel 6. The operation panel 6 includes a touch screen and hardware buttons. The touch screen displays screens on which software buttons and messages are arranged, and accepts a touching operation from a user. A plurality of hardware buttons are provided on the operation panel 6. The hardware buttons include, among others, a Start button for accepting from a user a request to execute a print job.

In a print job (copy job) involving reading of a document by the image reading portion 3, the operation panel 6 accepts a request to execute the print job from a user. When accepting the request to execute the print job, the operation panel 6 accepts a setting for sheet size specified by a user (the sheet size used in the print job). When the operation panel 6 accepts the request to execute the print job (when the Start button is operated), the control portion 1 makes the image reading portion 3 read a document. Then, the control portion 1 generates image data based on read data acquired by the image reading portion 3 reading a document, and makes the printing portion 4 print based on the generated image data.

The operation panel 6 functions as a notification part which gives a user various notifications. For example, when a jam occurs in the sheet conveying passage 40 while the print job is being executed, the operation panel 6 displays an error message indicating that a jam has occurred.

The image forming apparatus 100 includes a communication portion 7. The communication portion 7 is an interface for connecting the image forming apparatus 100 to a communication network CN such as a LAN. The communication portion 7 includes a communication circuit, a communication memory, and a communication connector.

The communication portion 7 is connected to the control portion 1. The control portion 1 communicates with a user terminal 200 connected to the communication network CN by use of the communication portion 7. The user terminal 200 is used by a user of the image forming apparatus 100. The user terminal 200 is, for example, a personal computer.

When the image forming apparatus 100 is used as a printer, job data, such as PDL (page description language) data, is transmitted from the user terminal 200 to the image forming apparatus 100. The job data includes information indicating the sheet size specified by a user (the sheet size used in the print job). When the communication portion 7 receives the job data, the control portion 1 recognizes that a request to execute the print job has been accepted from a user. When the communication portion 7 receives the job data, the control portion 1 generates image data based on the job data, and makes the printing portion 4 print based on the generated image data.

Sensing the State of Sheet

On accepting a request to execute the print job, the control portion 1 makes the printing portion 4 print. Here, the printing portion 4 (sheet feed portion 41) feeds a sheet P into the sheet conveying passage 40. The printing portion 4 (conveying portion 45) conveys the sheet P fed into the sheet conveying passage 40 along the sheet conveying passage 40.

After the sheet feed portion 41 has started to feed sheets P, the control portion 1 senses the state of the sheet P in the sheet conveying passage 40 based on the outputs of the first and second sensors 51 and 52. Then, based on the sensing results, the control portion 1 checks whether or not a jam has occurred in the sheet conveying passage 40.

On recognizing that a jam has occurred in the sheet conveying passage 40, the control portion 1 stops the feeding of sheets P by the printing portion 4 (the feeding of sheets P by the sheet feed portion 41 and the conveying of the sheets P by the conveying portion 45). The control portion 1 makes the operation panel 6 display an error message indicating that a jam has occurred. The error message displayed on the operation panel 6 leads a user to perform jam handling removing the jammed sheet P from the sheet conveying passage 40.

The control portion 1 sets a first time and a second time to perform the sensing by use of the first and second sensors 51 and 52. The first time is the time obtained by adding a first margin time to a first theoretical time required from the start of the feeding of a sheet P by the sheet feed portion 41 to the passage of the rear end of the sheet P at the first position P1. The second time is the time obtained by adding a second margin time to a second theoretical time required from the start of the feeding of a sheet P by the sheet feed portion 41 to the passage of the rear end of the sheet P at the second position P2.

The first theoretical time for setting the first time is previously determined, and can be calculated based on the conveying distance of the sheet P from an end part position (the position where the pickup roller 411 makes contact with the sheet P also will do) of the sheet conveying passage 40 on the upstream side in the sheet conveying direction to the first position P1, the conveying speed of the sheet P, and the length of the sheet P in the conveying direction. The second theoretical time for setting the second time is previously determined, and can be calculated based on the conveying distance of the sheet P from the end part position (the position where the pickup roller 411 makes contact with the sheet P also will do) of the sheet conveying passage 40 on the upstream side in the sheet conveying direction to the second position P2, the conveying speed of the sheet P, and the length of the sheet P in the conveying direction.

Here, due to, for example, secular deterioration of or an installation error in the pickup roller 411 (sheet feed portion 41), the time taken from the start of the feeding of a sheet P by the sheet feed portion 41 to the passage of the rear end of the sheet P at the first position P1 inconveniently varies. Likewise, the time taken from the start of the feeding of a sheet P by the sheet feed portion 41 to the passage of the rear end of the sheet P at the second position P2 varies. That is, even if the image forming apparatus 100 is normal, the time from the start of the feeding of a sheet P by the sheet feed portion 41 to the passage of the rear end of the sheet P at the first position P1 can be longer than the first theoretical time, and the time taken from the start of the feeding of a sheet P by the sheet feed portion 41 to the passage of the rear end of the sheet P at the second position P2 can be longer than the second theoretical time. To cope with that, how much the timing with which the rear end of the fed sheet P passes the first position P1 and the second position P2 delays with respect to the ideal timing is calculated experimentally or empirically. Then, based on the results, the first and second margin times are previously determined. The first and second margin times can be equal to or different from each other.

A plurality of different sheet sizes can be used in the print job, and information that defines the first and second theoretical times for each different sheet size is previously stored in the storage portion 2. Information defining the first and second margin times for setting the first and second times is also previously stored in the storage portion 2. On accepting a request to execute the print job, the control portion 1 recognizes the sheet size specified by a user (the sheet size used in the print job) and sets the first and second times based on the first and second theoretical times corresponding to the recognized sheet size.

After the sheet feed portion 41 has started to feed sheets P, based on the output of the first sensor 51, the control portion 1 performs first sensing in which it senses whether or not the rear end of the sheet P has passed the first position P1 within a first time of the start of the feeding of the sheet P by the sheet feed portion 41. When the rear end of the sheet P is sensed in the first sensing, that is, when the output of the first sensor 51 has changed from a value indicating that the sheet P is present to a value indicating that no sheet P is present within the first time, the control portion 1 recognizes that the rear end of the sheet P has normally passed the first position P1.

If a sheet P fed into the sheet conveying passage 40 jams, the movement of the sheet P can be slow or stops. As a result, while the state shown in FIG. 4 persists, the first time may elapse after the start of the feeding of a sheet P by the sheet feed portion 41. In the state shown in FIG. 4, the rear end of the sheet P has not yet passed the first position P1. Thus, the control portion 1 cannot sense the passage of the rear end of the sheet P at the first position P1 within the first time of the start of the feeding of the sheet P by the sheet feed portion 41.

Figure 4:
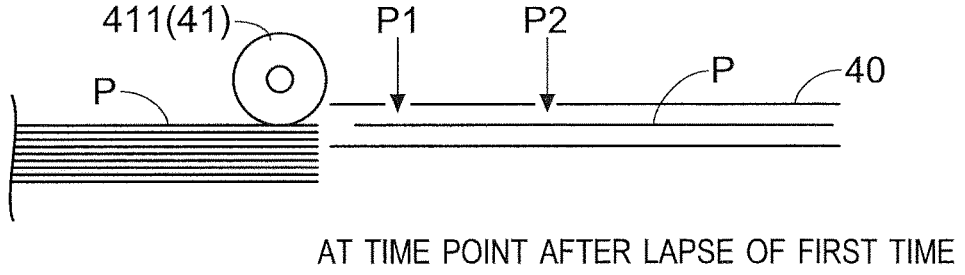
FIG. 4 is a diagram showing a state where a jam has occurred in a sheet conveying passage in the image forming apparatus according to the one embodiment of the present disclosure.

In the state shown in FIG. 4, the sheet P fed into the sheet conveying passage 40 has jammed, and thus the feeding of the sheet P can be stopped. If, despite the sheet P having jammed, the sheet P continues to be fed, the sheet P may tear. For example, the sheet P may fold into a zigzag.

Here, it can occur that, following a sheet P (precedent sheet P) fed into the sheet conveying passage 40 earlier, the next sheet P moves together. This state is shown in the upper part of FIG. 5. In the state shown in the upper part of FIG. 5, if the precedent sheet P has jammed, even when the sheet P continues to be conveyed, the rear end of the precedent sheet P does not pass the first position P1 within the first time (the state shown in the lower left part of FIG. 5). On the other hand, in the state shown in the upper part of FIG. 5, if the precedent sheet P has not jammed, the sheet P can continue to be conveyed, so that the rear end of the precedent sheet P passes the first position P1 within the first time (the state shown in the lower right part of FIG. 5).

Figure 5:
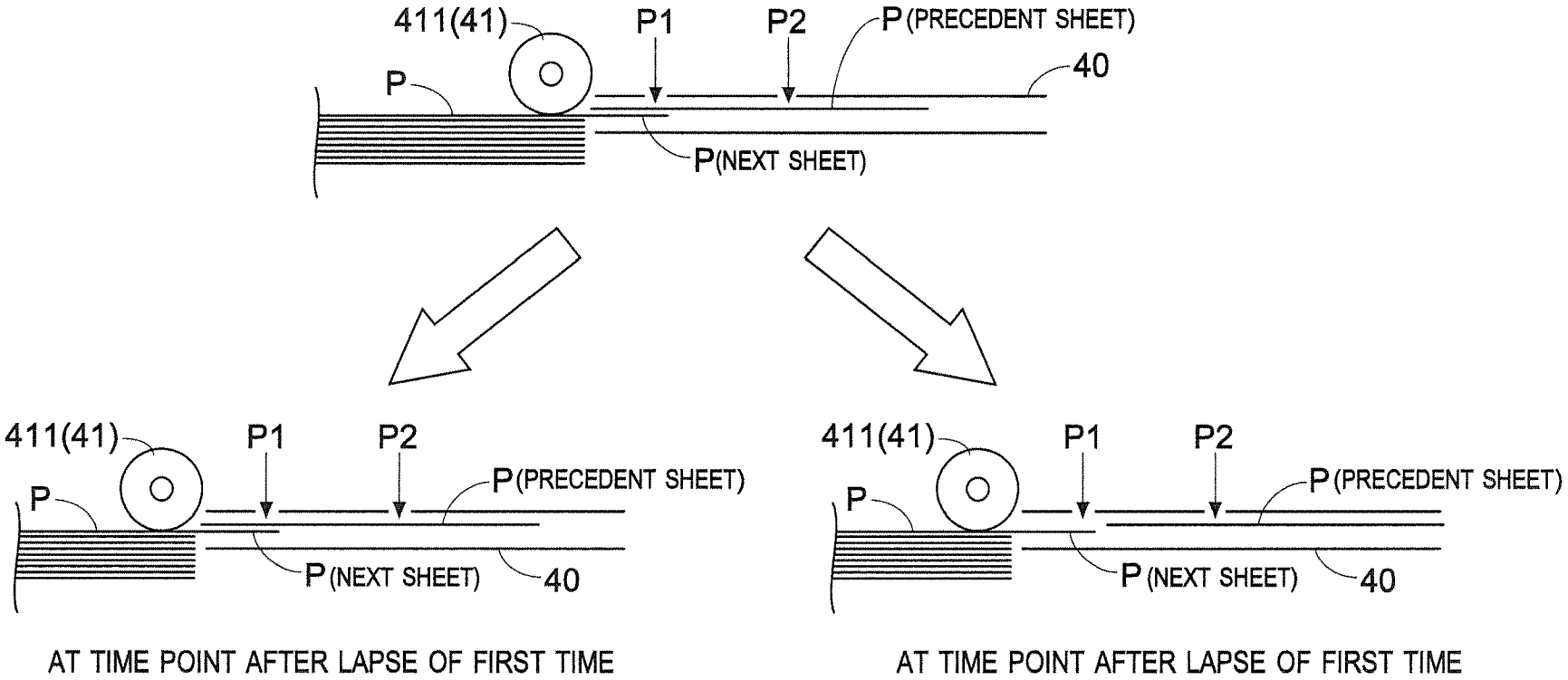
FIG. 5 is a diagram showing how a sheet is fed into the sheet conveying passage in the image forming apparatus according to the one embodiment of the present disclosure (as observed after a lapse of a first time)
Figure 6:
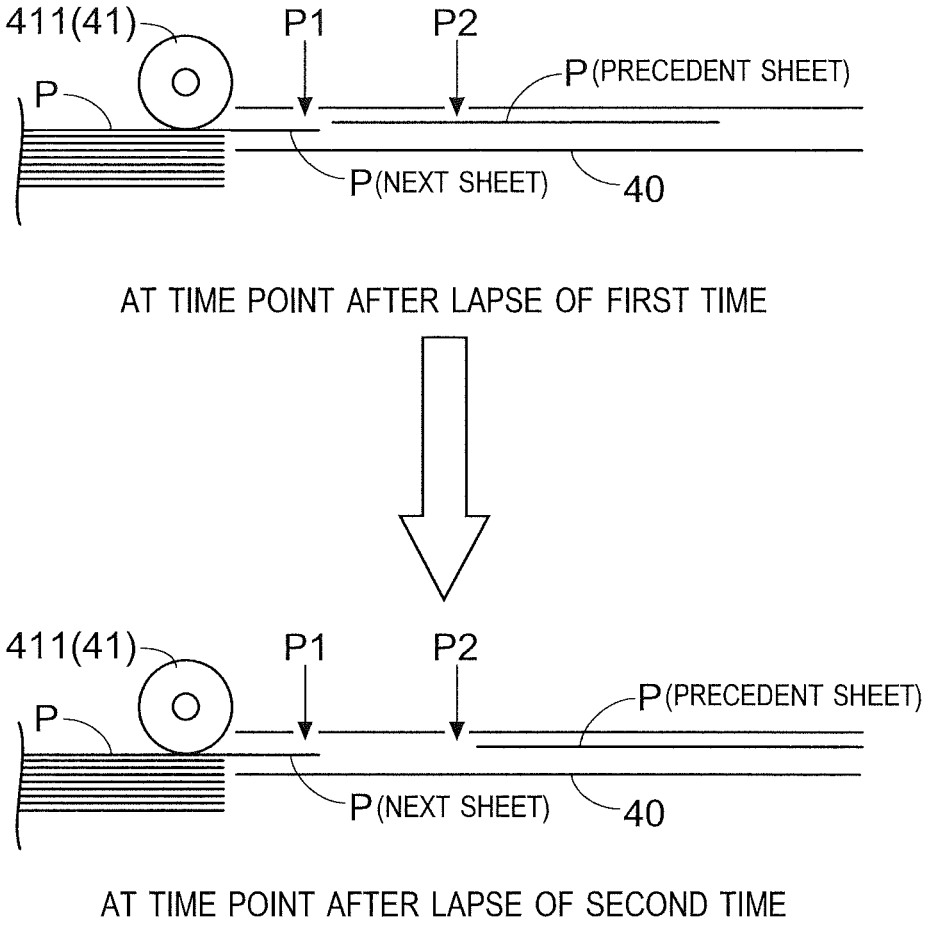
FIG. 6 is a diagram showing how a sheet is fed into the sheet conveying passage of the image forming apparatus according to the one embodiment of the present disclosure (as observed after a lapse of a second time)

In the state shown in the lower right part of FIG. 5, the sheet P has not jammed, and thus the sheet P can continue to be fed. However, in this case, although the rear end of the precedent sheet P has passed the first position P1, the next sheet P is at the first position P1 (the state where a part of the next sheet P is already at the first position P1). Thus, the control portion 1 cannot sense the passage of the rear end of the sheet P at the first position P1 within the first time of the start of the feeding of the sheet P by the sheet feed portion 41 (cannot sense the passage of the rear end of the sheet P in the first sensing).

To cope with that, after the sheet feed portion 41 has started to feed sheets P, based on the output of the second sensor 52, the control portion 1 performs second sensing in which it senses whether or not the rear end of the sheet P has passed the second position P2 within a second time of the start of the feeding of the sheet P by the sheet feed portion 41. Even if unable to sense the passage of the rear end of the sheet P in the first sensing, the control portion 1 does not at this point recognize that a jam has occurred, and makes the conveying portion 45 continue feeding sheets P.

Even if the control portion 1 is unable to sense the passage of the rear end of the sheet P in the first sensing, when it senses the passage of the rear end of the sheet P in the second sensing, that is, when the output of the second sensor 52 has changed from the value indicating that the sheet P is present to the value indicating that no sheet P is present within the second time, the control portion 1 recognizes that the rear end of the sheet P has normally passed the second position P2. When the state shown in the upper part of FIG. 6 (the state shown in the lower right part of FIG. 5) changes to the state shown in the lower part of FIG. 6, the control portion 1 senses the passage of the rear end of the sheet P in the second sensing. In this case, the control portion 1 makes the conveying portion 45 continue feeding sheets P. The control portion 1 also makes the sheet feed portion 41 feed the next sheet P.

Suppose that, in the previous print job, the print job was stopped due to a jam that occurred in the state shown in FIG. 4. In this case, an error message is displayed on the operation panel 6, and jam handling is performed by a user. In the state shown in FIG. 4, it is impossible to restart the print job. Thus, it does not occur that, when a first sheet P starts to be fed, the output values of the first and second sensors 51 and 52 are both the value indicating that the sheet P is present.

Here, it can occur that, when a first sheet P starts to be fed, only the output value of the first sensor 51 is the value indicating that the sheet P is present. That is, a part of the sheet P (the first sheet P) stored in the sheet feed cassette CA may be already at the first position P1. If only a part of the sheet P (the first sheet P) stored in the sheet feed cassette CA is already at the first position P1, the feeding of the first sheet P by the sheet feed portion 41 can be started with no problem. Thus, even if, when a first sheet P starts to feed, the output of the first sensor 51 is the value indicating that the sheet P is present, the control portion 1 makes the sheet feed portion 41 feed the first sheet P.

Figure 7:
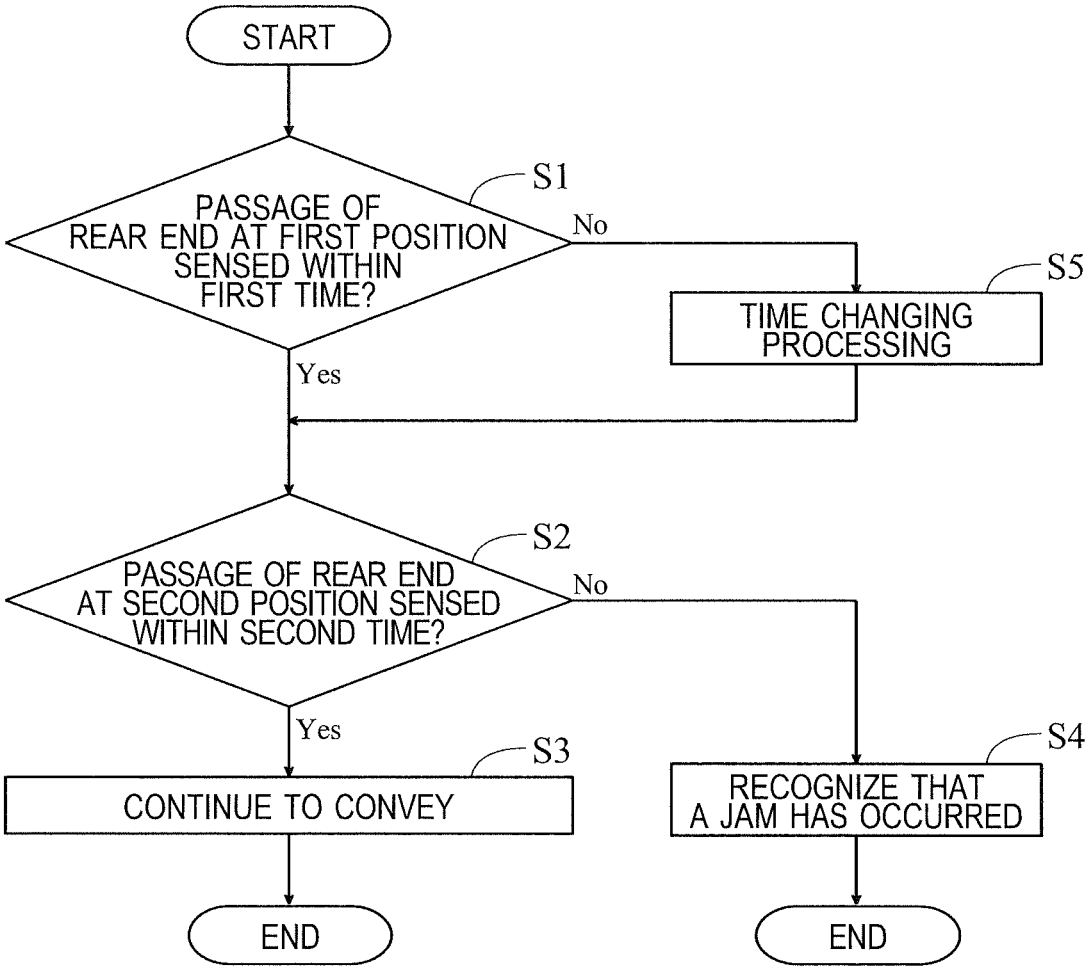
FIG. 7 is a flow chart showing the flow of the processing performed after the start of the feeding of the sheet by the control portion of the image forming apparatus according to the one embodiment of the present disclosure.

First, with reference to a flow chart shown in FIG. 7, the flow of the processing performed by the control portion 1 after the start of the feeding of a sheet P by the sheet feed portion 41 will be described. The control portion 1 performs, each time a sheet P is fed into the sheet conveying passage 40, the processing along the flow chart shown in FIG. 7. When a print job involves printing on a plurality of sheets, the processing along the flow chart shown in FIG. 7 is repeated.

At step S1, the control portion 1 performs the first sensing in which it senses whether or not the rear end of the sheet P has passed the first position P1 within the first time of the start of the feeding of the precedent sheet P by the sheet feed portion 41. As a result of the first sensing by the control portion 1, if the passage of the rear end of the precedent sheet P has been sensed, the flow proceeds to step S2.

When the flow proceeds to step S2, the control portion 1 performs the second sensing in which it senses whether or not the rear end of the sheet P has passed the second position P2 within the second time of the start of the feeding of the precedent sheet P by the sheet feed portion 41. As a result of the second sensing by the control portion 1, if the passage of the rear end of the precedent sheet P has been sensed, the flow proceeds to step S3.

Here, the fact that the passage of the rear end of the precedent sheet P is sensed at the first position P1 within the first time of the start of the feeding of the precedent sheet P by the sheet feed portion 41 means that the next sheet P is not moving together with the precedent sheet P. The fact that the passage of the rear end of the precedent sheet P is sensed at the second position P2 within the second time of the start of the feeding of the precedent sheet P by the sheet feed portion 41 means that, at that point, the movement of the precedent sheet P is not delayed or stopped. Thus, when the flow proceeds to step S3, the control portion 1 makes the conveying portion 45 continue to convey the precedent sheet P.

If, at step S2, as a result of the second sensing by the control portion 1, the passage of the rear end of the precedent sheet P is not sensed, the flow proceeds to step S4. When the flow proceeds to step S4, the control portion 1 recognizes that a jam has occurred in the sheet conveying passage 40.

On recognizing that a jam has occurred in the sheet conveying passage 40, the control portion 1 makes the operation panel 6 display an error message indicating that a jam has occurred. The control portion 1 also stops the feeding of sheets P by the printing portion 4. That is, the conveying of the precedent sheet P by the conveying portion 45 is stopped. The sheet feed portion 41 does not feed the next sheet P.

If, at step S1, as a result of the first sensing by the control portion 1, the passage of the rear end of the precedent sheet P is not sensed, the flow proceeds to step S5. Here, the fact that the passage of the rear end of the sheet P is not sensed at the first position P1 within the first time of the start of the feeding of the precedent sheet P by the sheet feed portion 41 means that the state shown in the lower left part of FIG. 5 or the state shown in the lower right part of FIG. 5 is in effect. However, based only on the output value of the first sensor 51, it is impossible to judge whether the state shown in the lower left part of FIG. 5 or the state shown in the lower right part of FIG. 5 is in effect. Thus, the control portion 1 does not at this point recognize that a jam has occurred in the sheet conveying passage 40.

When the flow proceeds to step S5, the control portion 1 performs time changing processing to change the second time. The control portion 1 performs the time changing processing and thereby makes the second time shorter than before the time changing processing. For example, the second margin time added to the second theoretical time can be shortened. If, when the state shown in the lower left part of FIG. 5 is in effect (when the precedent sheet P has jammed), the timing with which the conveying of the precedent sheet P is stopped delays, the precedent sheet P may tear. Thus, it is preferable that the timing with which the result of checking whether or not the precedent sheet P has jammed is obtained be hastened by shortening the second time.

After the processing at step S5, the flow proceeds to step S2. When the flow proceeds from step S5 to step S2, the control portion 1 senses, as the second sensing, whether or not the rear end of the precedent sheet P has passed the second position P2 within the second time, as it is after the time changing processing, of the start of the feeding of the precedent sheet P by the sheet feed portion 41. The second time is shorter when the time changing processing is performed than when the time changing processing is not performed. Thus, when the time changing processing is performed, the timing with which the result of checking whether or not the precedent sheet P has jammed is obtained is earlier than when the time changing processing is not performed.

Figure 8:
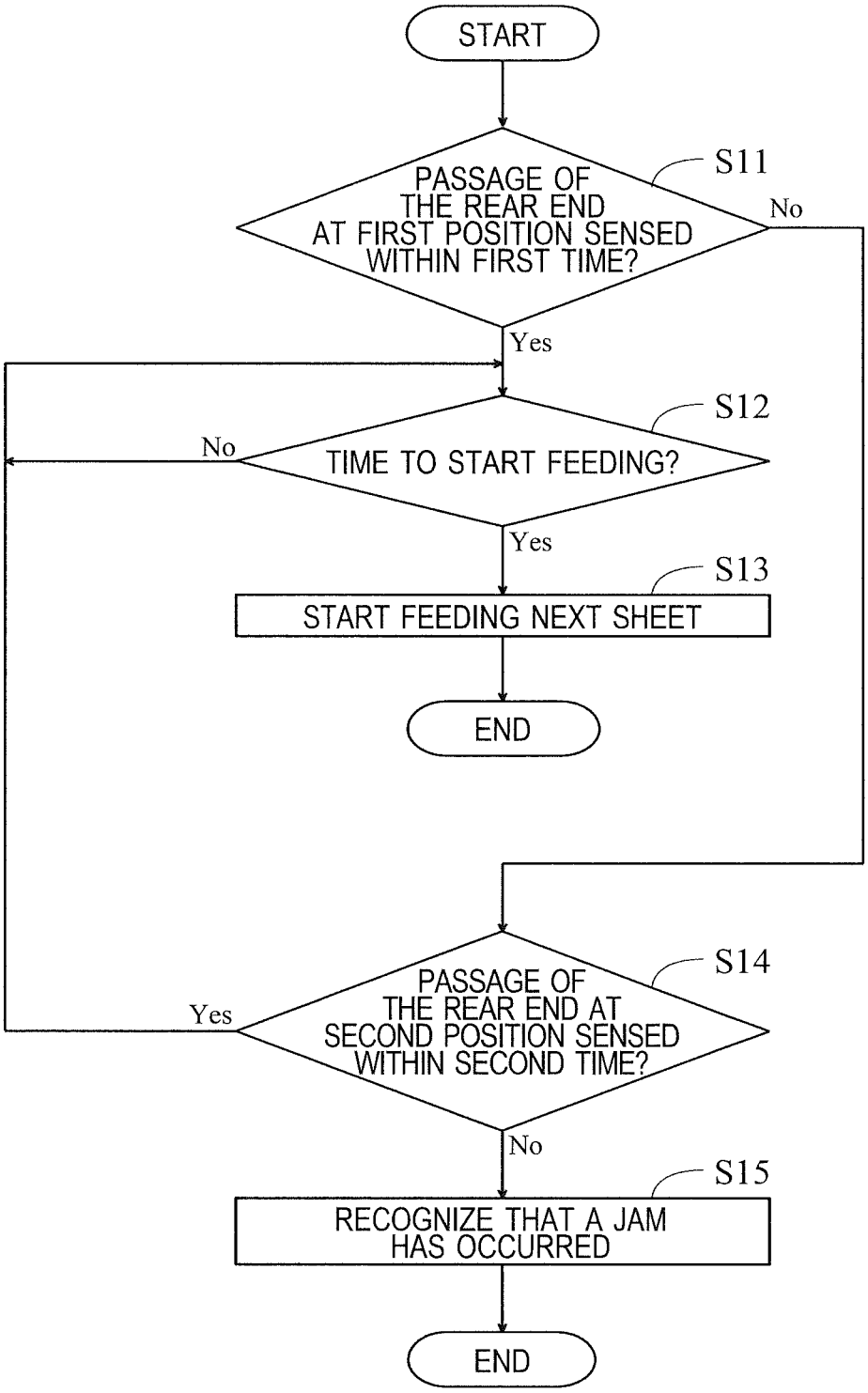
FIG. 8 is a flow chart showing the flow of the processing performed when the second or any subsequent sheet starts to be fed by the control portion of the image forming apparatus according to the one embodiment of the present disclosure.

Next, with reference to a flow chart shown in FIG. 8, the flow of the processing performed by the control portion 1 when the second or any subsequent sheet P starts to be fed by the sheet feed portion 41 will be described. The control portion 1 performs, every time the second or any subsequent sheet P starts to be fed by the sheet feed portion 41, the processing along the flow chart shown in FIG. 8.

At step S11, the control portion 1 performs the first sensing in which it senses whether or not the rear end of the precedent sheet P has passed the first position P1 within the first time of the start of the feeding of the precedent sheet P by the sheet feed portion 41. If, as a result of the first sensing by the control portion 1, the passage of the rear end of the precedent sheet P is sensed, the flow proceeds to step S12.

When the flow proceeds to step S12, the control portion 1 checks whether or not the timing of the start of the feeding of the next sheet P has come. For example, based on the time that elapses after the rear end of the precedent sheet P passes the first position P1 and the time that elapses after the rear end of the precedent sheet P passes the second position P2, the control portion 1 calculates the timing of the start of the feeding such that the interval (sheet interval) between the precedent sheet P and the next sheet P is in a permissible range.

If, at step S12, the control portion 1 recognizes that the timing of the start of the feeding has come, the flow proceeds to step S13, and if the control portion 1 recognizes that the timing of the start of the feeding has not come, the processing at step S12 is repeated. When the flow proceeds to step S13, the control portion 1 makes the sheet feed portion 41 start to feed the next sheet P.

If, at step S11, as a result of the first sensing by the control portion1, the passage of the rear end of the precedent sheet P is not sensed, the flow proceeds to step S14. When the flow proceeds to step S14, the control portion 1 performs the second sensing in which it senses whether or not the rear end of the sheet P has passed the second position P2 within the second time of the start of the feeding of the precedent sheet P by the sheet feed portion 41.

If, at step S14, as a result of the second sensing by the control portion 1, the passage of the rear end of the precedent sheet P is sensed, the flow proceeds to step S12. That is, when the state shown in the upper part of FIG. 6 changes the state shown in the lower part of FIG. 6, the flow proceeds to step S12. In this case, the sheet feed portion 41 feeds the next sheet P.

If, at step S14, as a result of the second sensing by the control portion 1, the passage of the rear end of the precedent sheet P is not sensed, the flow proceeds to step S15. That is, if, even when the second time elapses after the start of the feeding of the precedent sheet P by the sheet feed portion 41, the state shown in the lower left part of FIG. 5 is in effect, the flow proceeds to step S15. Although no illustration is given here, also if, after the start of the feeding of the precedent sheet P by the sheet feed portion 41, with the precedent sheet P and the next sheet P moving together, the second time elapses without the sheets P being separated, the flow proceeds to step S15. When the flow proceeds to step S15, the control portion 1 recognizes that a jam has occurred in the sheet conveying passage 40.

On recognizing that a jam has occurred in the sheet conveying passage 40, the control portion 1 makes the operation panel 6 display an error message indicating that a jam has occurred. The control portion 1 also stops the feeding of sheets P by the printing portion 4. Thus, the sheet feed portion 41 does not feed the next sheet P.

Here, when the print job is complete, based on the output of the first sensor 51, the control portion 1 checks whether or not a sheet P is present at the first position P1. As a result, on recognizing that the sheet P is present at the first position P1, the control portion 1 makes the operation panel 6 notify that the sheet P is remaining in the sheet conveying passage 40. The operation panel 6 displays notification information. For example, as notification information, there is displayed a message indicating that the sheet P is remaining in the sheet conveying passage 40 or a message for prompting the user to be careful when removing the sheet feed cassette CA.

The image forming apparatus 100 according to this embodiment includes, as described above, a sheet feed portion 41 (pickup roller 411) feeding a sheet P used in a print job into the sheet conveying passage 40, a conveying portion 45 (a conveying roller pair 42, a transfer roller pair 43, and a fixing roller pair 44) conveying the sheet P fed into the sheet conveying passage 40, a sheet feed sensor 5 having positions (P1 and P2) previously determined in the sheet conveying passage 40 as the detection positions and changing its output according to whether or not a sheet P is present at the detection positions, and a control portion 1 controlling the sheet feed portion 41 and the conveying portion 45 and sensing the arrival of the tip end of and the passage of the rear end of a sheet P at the detection positions in the sheet feed sensor 5 based on the output of the sheet feed sensor 5. The sheet feed sensor 5 is provided with a first sensor 51 having as the detection position a first position P1 in the sheet conveying passage 40, and a second sensor 52 having as the detection position a second position P2 on the downstream side, in the sheet conveying direction, of the first position P1 in the sheet conveying passage 40. The control portion 1 sets to a first time the time obtained by adding a first margin time to a first theoretical time required from the start of the feeding of a sheet P by the sheet feed portion 41 to the passage of the rear end of the sheet P at the first position P1, and set to a second time the time obtained by adding a second margin time to a second theoretical time required from the start of the feeding of a sheet P by the sheet feed portion 41 to the passage of the rear end of the sheet P at the second position P2. Based on the output of the first sensor 51, the control portion 1 performs first sensing in which it senses whether or not the rear end of the sheet P has passed the first position P1 within a first time of the start of the feeding of the sheet P by the sheet feed portion 41, and based on the output of the second sensor 52, the control portion 1 performs second sensing in which it senses whether or not the rear end of the sheet P has passed the second position P2 within a second time of the start of the feeding of the sheet P by the sheet feed portion 41. Even if the control portion 1 is unable to sense the passage of the rear end of the sheet P at the first position P1, when it senses the passage of the rear end of the sheet P in the second sensing, it makes the conveying portion 45 continue feeding the sheet P.

In the configuration according to this embodiment, the control portion 1 performs the first sensing. Even if, as a result of the first sensing, the control portion 1 is unable to sense the passage of the rear end of the precedent of the sheet P, it does not stop the conveying of the sheet P by the conveying portion 45 (does not recognize that a jam has occurred). This is because, although the precedent sheet P may have jammed, the next sheet P may be already at the first position P1 resulting from the precedent sheet P and the next sheet P moving together.

Here, if the precedent sheet P has jammed, even when the sheet P continues to be conveyed, the rear end of the precedent sheet P is unlikely to pass the second position P2 within the second time. On the other hand, if the next sheet P is already at the first position P1, when the sheet P continues to be conveyed, the precedent sheet P and the next sheet P may be separated, and in this state, the rear end of the precedent sheet P may pass the second position P2.

To cope with that, the control portion 1 performs the second sensing. If, as a result of the second sensing, the control portion 1 senses the passage of the rear end of the precedent sheet P, it can continue to convey the sheet P (does not recognize that a jam has occurred). It is thereby possible to prevent the conveying of the sheet P from being stopped unnecessarily. If the conveying of the sheet P is stopped unnecessarily, productivity is reduced. Furthermore, normally unnecessary jam handling has to be performed; this is troublesome to a user. In this embodiment, it is possible to prevent such inconveniences.

In this embodiment, as described above, if unable to sense the passage of the rear end of the sheet P in the first sensing, the control portion 1 performs the time changing processing to change the second time, thereby making the second time shorter than before the time changing processing, and performs the second sensing based on the second time changed through the time changing processing (the second time which is shorter than before the time changing processing).

Here, as described above, even if the control portion 1 is unable to sense the passage of the rear end of the precedent sheet P in the first sensing, it continues to convey the sheet P. However, when the precedent sheet P has actually jammed, if the sheet P continues to be conveyed, the precedent sheet P may fold into a zigzag and tear. Thus, the control portion 1 shortens the second time. It is thereby possible to hasten the timing with which the result of checking whether or not the precedent sheet P has jammed is obtained, and thus even when the precedent sheet P has actually jammed, it is possible to prevent the precedent sheet P from tearing.

In this embodiment, as described above, even if the control portion 1 is unable to sense the passage of the rear end of the sheet P in the first sensing, when it senses the passage of the rear end of the sheet P in the second sensing, it makes the sheet feed portion 41 feed the next sheet P. The fact that the passage of the rear end of the sheet P is not sensed in the first sensing but the passage of the rear end of the sheet P is sensed in the second sensing means that the next sheet P is already at the first position P1; this does not mean that a jam has occurred. Thus, in this case, the sheet feed portion 41 can perform the feeding of the next sheet P with no problem.

In this embodiment, as described above, if the control portion 1 is neither able to sense the passage of the rear end of the sheet P in the first sensing nor also unable to sense the passage of the rear end of the sheet P in the second sensing, that is a jam is likely to have occurred, the control portion 1 stops the feeding of the sheet P by the sheet feed portion 41 and the conveying of the sheet P by the conveying portion 45. Thus, despite the sheet P having jammed, it is possible to prevent the sheet P from continuing to be conveyed.

In this embodiment, as described above, when the print job is complete, based on the output of the first sensor 51, the control portion 1 checks whether or not the sheet P is present at the first position P1. On recognizing that the sheet P is present at the first position P1, the control portion 1 makes the operation panel 6 (notification part) notify that the sheet P is remaining in the sheet conveying passage 40. It is thereby possible to make a user recognize that a part of the sheet P stored in the sheet feed cassette CA is already at the first position P1.

The embodiment disclosed herein should be understood to be in every respect illustrative and not restrictive. The scope of the present disclosure is not defined by the description of embodiments given above but by the appended claims, and encompasses any modifications made in the sense and scope equivalent to those of the claims.

What is claimed is:

1. An image forming apparatus comprising:

a sheet feed portion that feeds a sheet used in a print job into a sheet conveying passage;

a conveying portion that conveys the sheet fed into the sheet conveying passage;

a sheet feed sensor that has a detection position at a position previously determined in the sheet conveying passage, the sheet feed sensor changing an output thereof according to whether or not a sheet is present at the detection position; and a control portion that controls the sheet feed portion and the conveying portion, the control portion sensing an arrival of a tip end of and a passage of a rear end of a sheet at the detection position based on an output of the sheet feed sensor, wherein the sheet feed sensor includes a first sensor having the detection position at a first position in the sheet conveying passage, and a second sensor having the detection position at a second position on the downstream side, in the sheet conveying direction, of the first position in the sheet conveying passage, the control portion sets a first time equal to a time obtained by adding a first margin time to a first theoretical time required from a start of feeding of a sheet by the sheet feed portion to the passage of the rear end of the sheet at the first position, and a second time equal to a time obtained by adding a second margin time to a second theoretical time required from the start of the feeding of a sheet by the sheet feed portion to the passage of the rear end of the sheet at the second position, and the control portion performs, based on the output of the first sensor, first sensing in which the control portion senses whether or not the rear end of the sheet has passed the first position within the first time of the start of the feeding of the sheet by the sheet feed portion, performs, based on the output of the second sensor, second sensing in which the control portion senses whether or not the rear end of the sheet has passed the second position within the second time of the start of the feeding of the sheet by the sheet feed portion, and, even if unable to sense the passage of the rear end of the sheet in the first sensing, when the passage of the rear end of the sheet is sensed in the second sensing, makes the conveying portion continue feeding the sheet.

2. The image forming apparatus according to claim 1, wherein, if unable to sense the passage of the rear end of the sheet in the first sensing, the control portion performs time changing processing to change the second time to make the second time shorter than before the time changing processing, and performs the second sensing based on the second time changed through the time changing processing.

3. The image forming apparatus according to claim 1, wherein, even if unable to sense the passage of the rear end of the sheet in the first sensing, when the passage of the rear end of the sheet is sensed in the second sensing, the control portion makes the sheet feed portion feed a next sheet.

4. The image forming apparatus according to claim 1, wherein, if the control portion is neither able to sense the passage of the rear end of the sheet in the first sensing nor able to sense the passage of the rear end of the sheet in the second sensing, the control portion stops the feeding of the sheet by the sheet feed portion and the conveying of the sheet by the conveying portion.

5. The image forming apparatus according to claim 1, further comprising:

a notification part, wherein when the print job is complete, based on the output of the first sensor, the control portion checks whether or not the sheet is present at the first position, and when the control portion recognizes that the sheet is present at the first position, the control portion makes the notification part notify that the sheet is remaining in the sheet conveying passage.

* * * * *